US007300069B2

(12) United States Patent
Schretter

(10) Patent No.: US 7,300,069 B2
(45) Date of Patent: Nov. 27, 2007

(54) SKI

(75) Inventor: Herwig Schretter, Wien (AT)

(73) Assignee: Tyrolia Technology GmbH (AU)

( * ) Notice: Subject to any disclaimer, the term of this patent is extended or adjusted under 35 U.S.C. 154(b) by 5 days.

(21) Appl. No.: 10/722,668

(22) Filed: Nov. 25, 2003

(65) Prior Publication Data

US 2004/0108687 A1 Jun. 10, 2004

(30) Foreign Application Priority Data

Nov. 29, 2002 (EP) ..... 02026618

(51) Int. Cl.
*A63C 9/00* (2006.01)

(52) U.S. Cl. ..... 280/607; 280/618; 280/601

(58) Field of Classification Search ..... 280/601, 280/608, 609, 610, 607, 617, 618
See application file for complete search history.

(56) References Cited

U.S. PATENT DOCUMENTS

| | | | | | |
|---|---|---|---|---|---|
| 3,915,465 | A * | 10/1975 | Matsuda | 280/607 |
| 3,915,466 | A * | 10/1975 | Matsuda | 280/617 |
| 4,022,491 | A * | 5/1977 | Powell | 280/618 |
| 5,018,468 | A * | 5/1991 | Peterson | 114/39.19 |
| 5,431,427 | A * | 7/1995 | Pieber et al. | 280/607 |
| 5,525,083 | A * | 6/1996 | Reich | 441/68 |
| 5,544,908 | A * | 8/1996 | Fezio | 280/610 |
| 5,558,552 | A * | 9/1996 | Namur | 441/75 |
| 5,836,604 | A * | 11/1998 | Piegay | 280/607 |
| 5,865,459 | A * | 2/1999 | Piegay | 280/602 |
| RE36,453 | E * | 12/1999 | Abondance et al. | 280/609 |
| 6,382,658 | B1 * | 5/2002 | Stubblefield | 280/609 |
| 6,612,605 | B2 * | 9/2003 | Andrus et al. | 280/610 |
| 6,619,688 | B2 * | 9/2003 | Billon et al. | 280/607 |
| 6,666,471 | B2 * | 12/2003 | Gatel | 280/602 |
| 6,840,531 | B2 * | 1/2005 | Gorza et al. | 280/617 |
| 6,848,703 | B2 * | 2/2005 | Godde et al. | 280/607 |

FOREIGN PATENT DOCUMENTS

| | | |
|---|---|---|
| CH | 671887 | 10/1989 |
| EP | 0 607 543 | 7/1994 |
| EP | 1 277 500 | 1/2003 |
| FR | 2 785 548 | 5/2000 |
| FR | 2 815 879 | 5/2002 |

* cited by examiner

*Primary Examiner*—Christopher P. Ellis
*Assistant Examiner*—Vaughn T. Coolman
(74) *Attorney, Agent, or Firm*—Ostrolenk, Faber, Gerb & Soffen, LLP

(57) ABSTRACT

A sliding board, such as a ski, with at least one interface element or guide element, connected to the sliding board via fastening elements, for arranging binding elements or the like on the upper side of the sliding board. The sliding board has a single-ply or multi-ply upper and lower skin, a running surface, and if appropriate, steel edges, and a foamed core. The interface element or guide element is arranged in a positionally fixed manner on the sliding board by at least one of the fastening elements and is allowed limited mobility in the longitudinal direction of the sliding board by at least one of the other fastening elements. The at least one fastening element fixing the interface element or guide element in a positionally fixed manner is advantageously integrated into the foam during foaming of the core and hardening of the foam.

19 Claims, 4 Drawing Sheets

SKI

BACKGROUND OF THE INVENTION

1. Field of the Invention

The invention relates to a sliding board, in particular a ski, with at least one guide element, connected to the sliding board via fastening elements, for arranging binding elements and the like on the upper side of the sliding board. The board may have a single-ply or multi-ply upper and lower skin, a running surface, and if appropriate, steel edges, and a foamed core.

2. Related Art

Sliding boards made in this way are described in the as yet unpublished Austrian utility model application no. GM 632/2002 and the likewise as yet unpublished European patent application no. 02015378.9 of the applicant. The sliding boards provided with a foamed core according to these applications have interface or guide elements which are held in the ski by means of fastening elements which are in particular integrated into the ski structure or sliding board structure during foaming and held in the sliding board by the hardened foam.

Another version of a sliding board with a guide system is known from EP-A-1 161 072. This guide system consists of a pair of profiled rails which are connected to the sliding board body by a dowel connection or dowel anchoring via at least one formed-on dowel or dowel portion. The fastening of the profiled rails is carried out on the sliding board when it is already finished and consequently simply replaces the otherwise customary screw fastening. In the region of the fastened profiled rails, ski deflection is not possible or is greatly impeded.

SUMMARY OF THE INVENTION

The invention solves the foregoing problems, by fixing guide elements to a sliding board in such a way that deflection of the elements is permitted or is not impeded.

According to an aspect of the invention, a guide element is arranged in a positionally fixed manner on the sliding board by at least one of the fastening elements, and is fastened so as to allow limited mobility in the longitudinal direction of the sliding board by the other fastening element or elements, and the fastening element fixing the guide element in a positionally fixed manner may be integrated into the foam during foaming of the core and hardening of the foam.

This arrangement of the guide elements on the sliding board consequently permits deflection of the sliding board during use.

In this connection, the guide element is preferably arranged in a positionally fixed manner in one of its end regions in the longitudinal direction, this end region preferably being that which lies closer to the center of the sliding board. The positionally fixed arrangement of the one or more guide elements therefore takes place in particular in the region of the center of the ski between the ski ends and supports the desired mobility of the ski or sliding board.

The fastening element arranging the guide element in a positionally fixed manner can be either firmly connected to the guide element or made in one piece with it. Both variants permit simple and expedient embodiment of the invention.

The other fastening elements hold the guide element at least in the vertical direction and in the transverse direction. In a first embodiment of the invention, the other fastening elements are anchored firmly in the sliding board, and the guide element is movable by a limited distance in the longitudinal direction in relation to these. This embodiment is particularly simple to manufacture. In this connection, these fastening elements may be either integrated during foaming of the core and hardening of the foam or anchored firmly before foaming to components integrated in that way.

The limited mobility of the guide elements in the longitudinal direction of the sliding board can be ensured in a simple way by receiving locations or receiving openings which are provided in the guide elements for the other fastening elements, these receiving locations having or making available clearances in the longitudinal direction of the sliding board.

In a second embodiment of the invention, the guide element is, together with the other fastening elements, arranged for limited movement in the longitudinal direction in relation to the sliding board. This embodiment as well can be manufactured simply by, for example, arranging the other fastening elements for limited movement, in the interior of the sliding board, with respect to receiving parts which may be integrated during foaming of the core and hardening of the foam.

This embodiment is particularly advantageous when the receiving parts located in the interior of the sliding board for the fastening elements are components of a framework or the like integrated into the sliding board interior.

The receiving parts are in particular made in such a way that they have receiving openings in which the other fastening elements are held, in a positionally fixed manner at least in the vertical direction and in the transverse direction according to this embodiment.

In a third embodiment, in which the guide element is, together with the other fastening elements, movable in relation to the sliding board, the other fastening elements are arranged for limited movement both within the receiving openings of the receiving parts and in relation to the upper skin. This can be ensured in a simple way by providing clearances in the openings in the upper skin and in the receiving openings of the receiving parts.

Additionally, the manufacture of a sliding board made according to embodiments of the invention is simplified if the other fastening elements are held or anchored in the receiving parts provided in the interior of the sliding board by snapping-in, locking or the like.

BRIEF DESCRIPTION OF THE DRAWINGS

Further features, advantages and details of the invention are now described in greater detail with reference to the drawings which illustrate a number of illustrative embodiments. The figures are diagrammatic illustrations in which.

DETAILED DESCRIPTION OF EMBODIMENTS OF THE INVENTION

Figure 1:
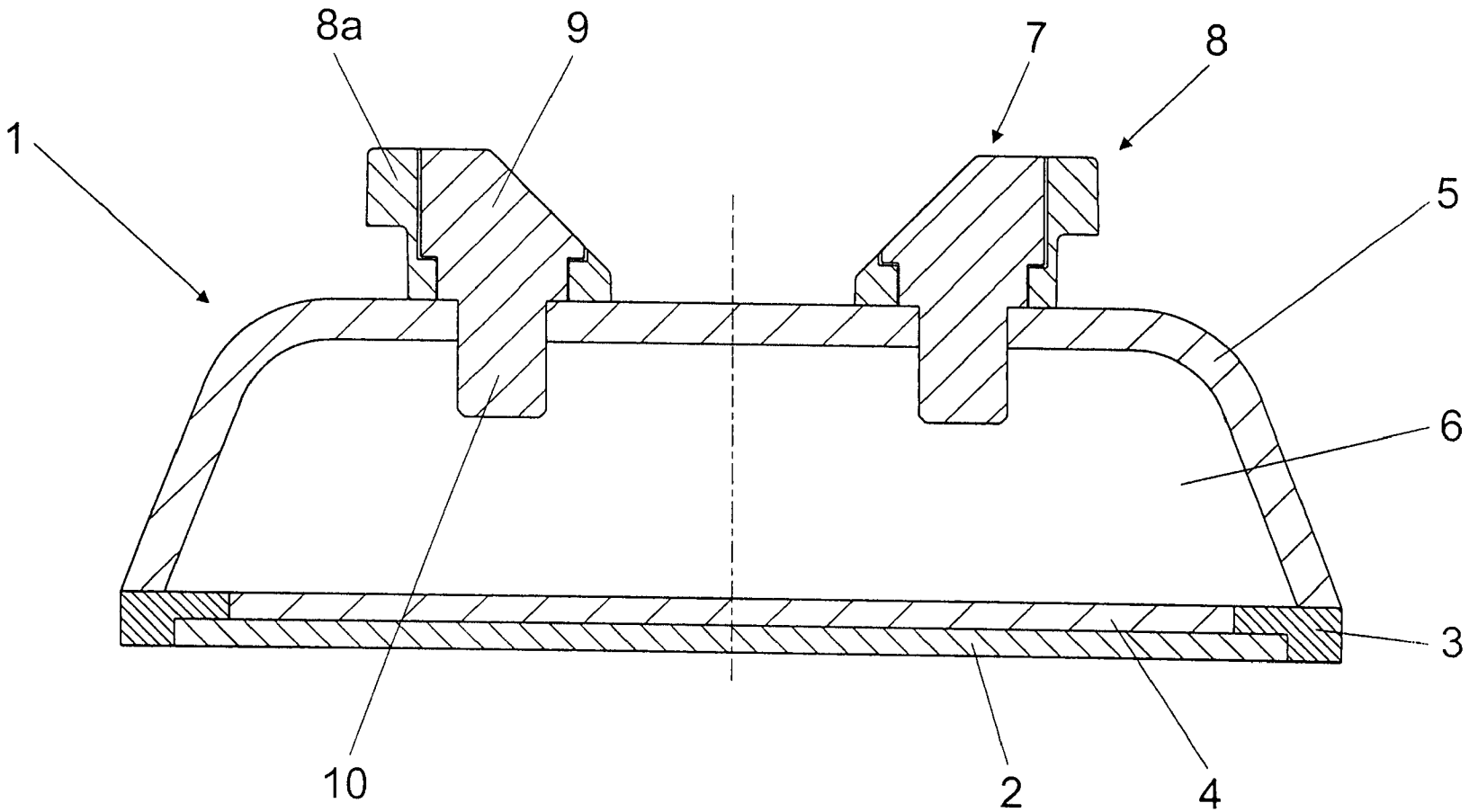
FIG. 1 is a cross section through a ski according to a first embodiment of the invention, taken along line B-B in FIG. 3.
Figure 2:
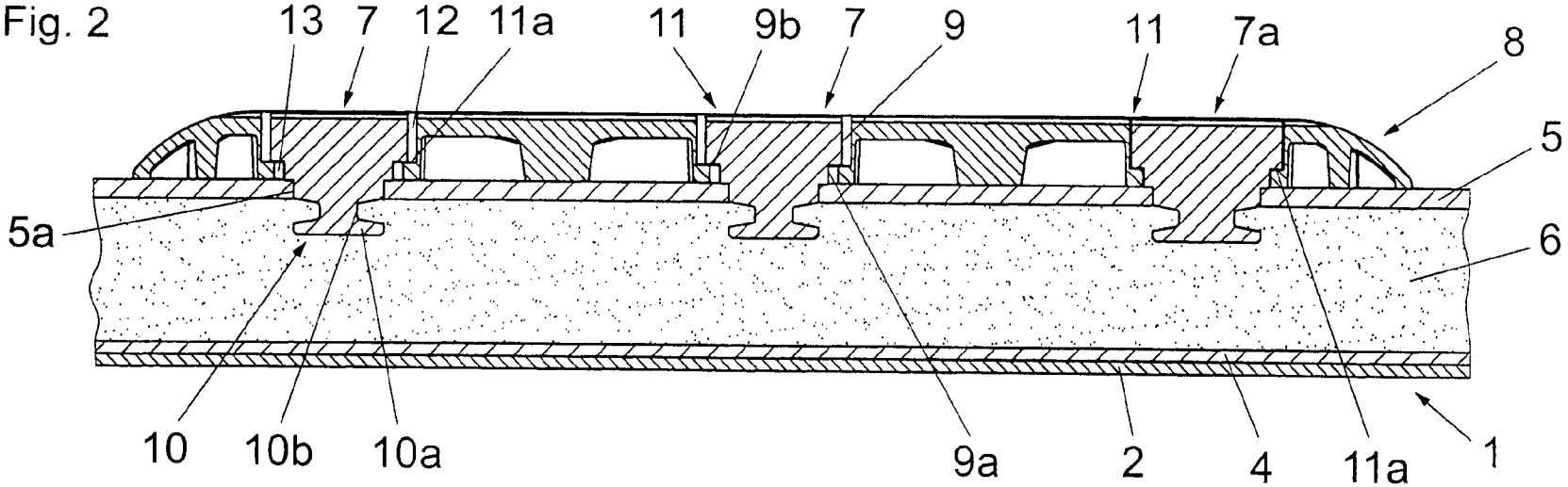
FIG. 2 is a partial cross-section of the illustrative embodiment in FIG. 1, with reference to a longitudinal section taken along line A-A in FIG. 3.

FIG. 1 and FIG. 2 show sections through a ski 1, which has a running surface 2, steel edges 3, a single-ply or multi-ply lower skin 4 and a single-ply or multi-ply upper skin 5. The core 6 of the ski is foamed and anchors fastening elements 7, 7*a* for profiled guide elements 8 which here are in the form of rails and extend parallel to one another. The guide elements 8 provided as a pair in this embodiment serve for receiving pushed-on functional elements of a ski binding, for example a front or a rear binding part or a base-plate, support plate or the like. The fastening elements 7, 7*a* are integrated and fixed in the ski 1 during the foaming process and the subsequent hardening of the foamed material of the core 6. In the embodiment shown in FIG. 1 and FIG. 2, three fastening elements, two of which are provided with reference number 7 and one of which is provided with reference number 7*a*, are in each case provided per guide element 8. As shown in particular in FIG. 2 and FIG. 3, the two profiled guide elements 8 are, for example, provided with guide strips 8*a*, so that the binding part, the support plate or the like can readily be pushed onto the guide element(s) and there arranged for sliding movement on the guide element(s).

The fastening elements 7, 7*a* holding the guide elements 8 on the upper side of the ski 1 each have an anchoring part 10 and a connecting part 9. The anchoring part 10 comprises that part of the fastening element 7, 7*a* which extends into the interior of the ski 1, the connecting part 9 that part which remains above the upper side of the ski. The anchoring part 10 has an elongated foot part 10*a* which extends in the longitudinal direction of the ski in the embodiment illustrated and is provided with an indentation 10*b* on each of its longitudinal sides. The foot part 10*a* can be of various kinds; the important aspects are the provision of surfaces or regions which enlarge the surface for adhesion to the foamed material of the core 6, such as the indentations 10*b* for example, and the possibility of guiding and positioning the fastening element 7, 7*a* through an opening 5*a* punched out in the upper skin 5 during manufacture of the ski 1. Elements which enlarge the adhesion surface can be attached, for example clipped on or screwed on, to the anchoring part 10 subsequently, after its positioning in the upper skin 5.

Each fastening element 7, 7*a* lies on the upper side of the upper skin 5 via a shoulder 9*a* running around the edge of the opening 5*a*. Another shoulder 9*b* adjoining the shoulder 9*a* and formed via a step allows the respective fastening element 7, 7*a* to be upported on a supporting surface 11*a* of a receiving opening 11 in the guide element 8. The shape of the receiving openings 11 selected for this embodiment, essentially rectangular and oriented in the longitudinal direction of the ski, can be seen in the top view shown in FIG. 3 of the pair of guide elements 8.

Figure 3:
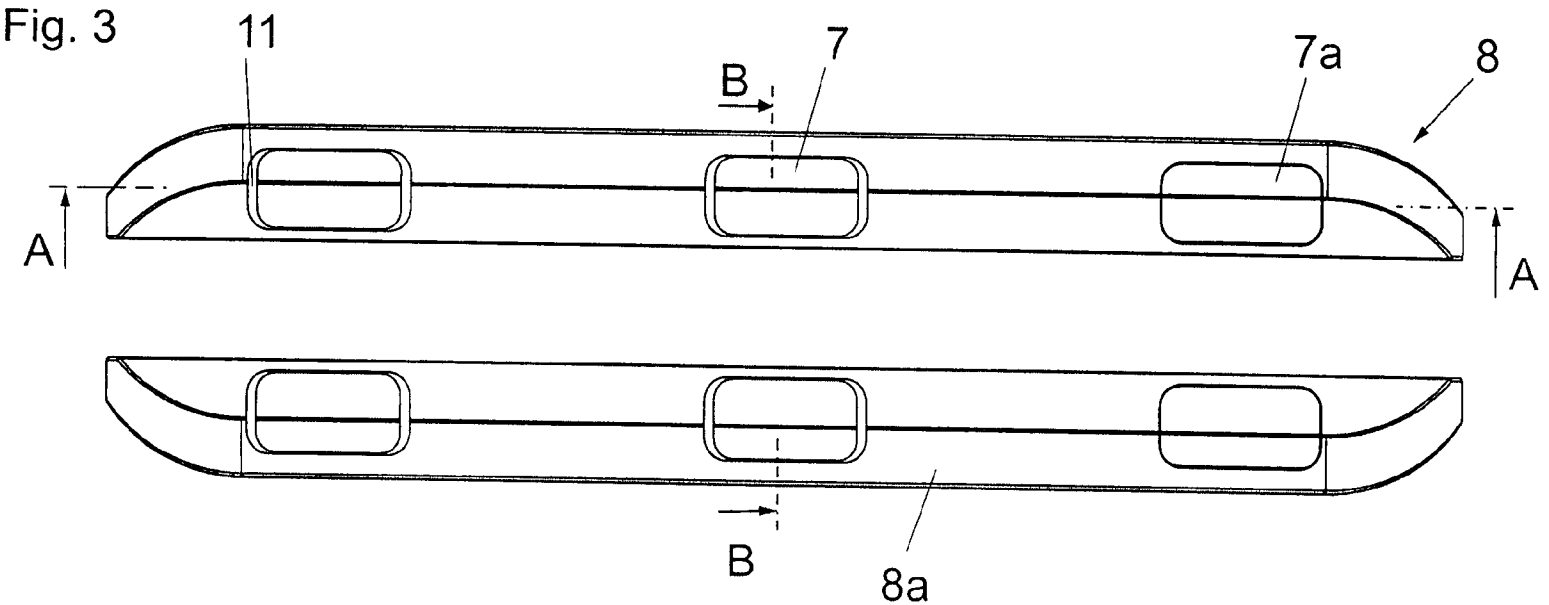
FIG. 3 is a top view of a pair of guide elements.

As shown in FIG. 2 and FIG. 3, the fastening element designated by reference number 7*a* is provided in the end region of the guide element 8 and is connected to the guide element 8 in the longitudinal direction of the ski in a fixed and immovable manner by virtue of the receiving opening 11 and the connecting part 9 mating with an exact fit. On the other hand, clearances 12, 13 are provided extending in the longitudinal direction of the ski 1, in the openings 11 receiving the two other fastening elements 7. The clearances 12 are in each case located between the connecting part 9 and the walls delimiting the receiving opening 11 in the longitudinal direction of the ski and above the supporting surface 11*a*, the clearances 13 between the shoulders 9*a* and the wall regions delimiting the receiving opening 11 in the longitudinal direction of the ski and extending below the supporting surface 11*a*. The two other fastening elements 7 consequently permit limited mobility of the guide elements 8 in the longitudinal direction of the ski.

As already mentioned, the connection of the two guide elements 8 to the ski 1 takes place during manufacture of the latter. To this end, all the fastening elements 7, 7*a* are positioned in the receiving openings 11 of the guide elements 8, the guide elements 8 are positioned on the upper skin material, and the fastening elements 7, 7*a* are anchored in the core material during foaming of the core 6. It is also possible for the fastening element 7*a* connected to the guide element 8 in a fixed and immovable manner to be made in one piece with the latter.

Figure 4:
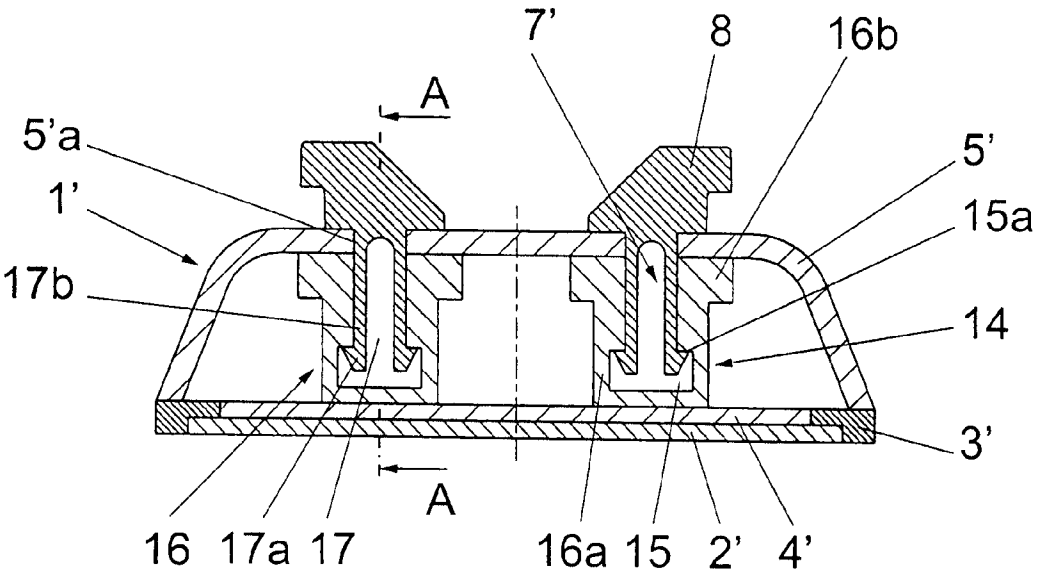
FIG. 4 is a transverse cross section through a ski according to a second embodiment of the invention.
Figure 5:
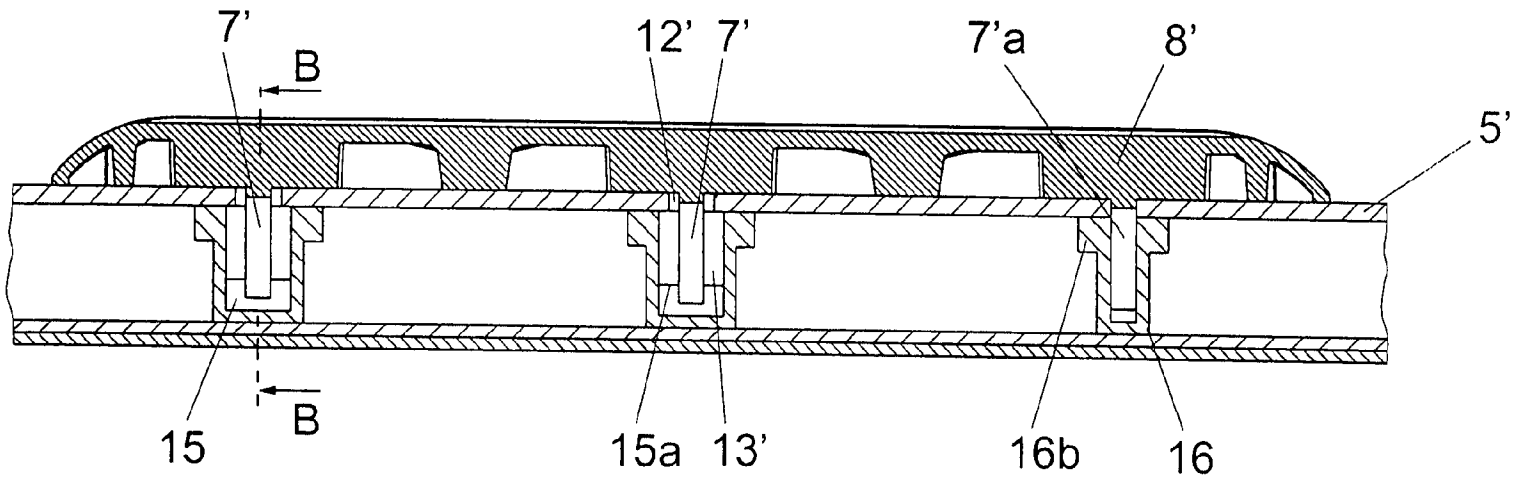
FIG. 5 is a partial longitudinal cross-section of a ski according to the second embodiment.

In the embodiment shown in FIGS. 4 and 5, the ski 1' is likewise provided with a running surface 2', steel edges 3', a single-ply or multi-ply lower skin 4' and a single-ply or multi-ply upper skin 5'. Contained in the interior of the ski is a framework 14 which has receiving parts 16 for three fastening elements 7', 7'*a*. Each receiving part 16 is self-contained and comprises a base part 16*a* having a central opening 15 and bearing against the lower skin 4' and an all-round supporting flange 16*b* bearing against the inner side of the upper skin 5'. The supporting flange 16*b* surrounds an opening 5'*a* in the upper skin 5', which opening is adjoined by the central opening 15 in the receiving part 16. The receiving opening 15 has a widened region on the inside, so that locking locations for hook-like catching parts 17*a* of the fastening elements 7', 7'*a* are formed via shoulders 15*a* which are oriented in the longitudinal direction of the ski. In this embodiment, all the fastening elements 7', 7'*a* are designed in one piece with the guide elements 8' which likewise extend in the form of profiled rail pairs on the upper side of the ski 1'.

The hook-like catching parts 17*a* are provided at the free ends of catching elements 17*b* of the fastening elements 7', 7'*a*, which catching elements are separated from one another by a central slot 17. The central slot 17 allows the two catching elements 17*b* to be pressed together when the fastening elements 7', 7'*a* are mounted.

The framework 14 accommodated in the interior of the ski can have further supporting struts (not illustrated here) such as, for example, webs extending between upper skin and lower skin or connecting struts between the individual receiving parts 16, and also other components (not shown). With regard to the design and embodiment of the framework 14, reference is made to, for example, the as yet unpublished European patent application no. 02015378.9 of the applicant.

The cavities remaining in the interior of the ski outside the receiving parts 16 and the framework 14 are filled with foamed material. On the other hand, the receiving opening 15 in each of the receiving parts 16 is not filled with foamed material.

In the case of the two fastening elements 7', as the longitudinal section in FIG. 5 shows, clearances 12', 13' are present in the longitudinal direction of the ski between the catching elements 17*b* and the end regions in the longitudinal direction of the ski of the essentially rectangular opening 5'*a* in the upper skin 5' and also in the receiving opening 15. The third fastening element 7'*a* is located in a fixed, immovable manner in the receiving part 16 and the opening 5'*a* in the upper skin 5'. Limited relative movement can consequently take place between the guide elements 8' and the ski 1' in the longitudinal direction of the ski by virtue of the arrangement of the fastening elements 7'. The fastening element 7'*a* anchored in a positionally fixed manner in the ski 1' can also be anchored in the ski 1' in a different way; it can, for example, be held in the foamed material of the core 6'.

Figure 6:
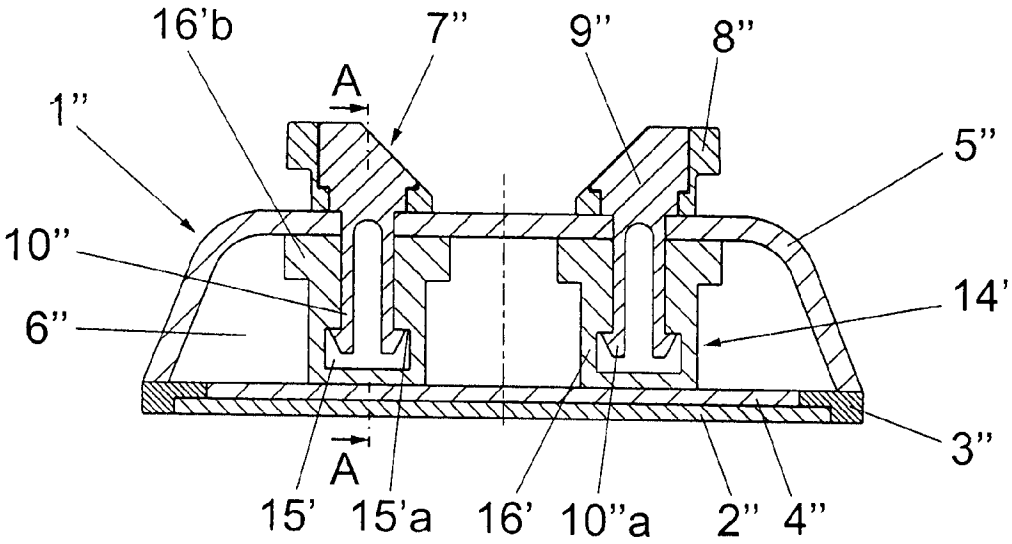
FIGS. 6 and 7 show a third embodiment of the invention, likewise showing the third embodiment in transverse cross section and partial longitudinal section, respectively.
Figure 7:
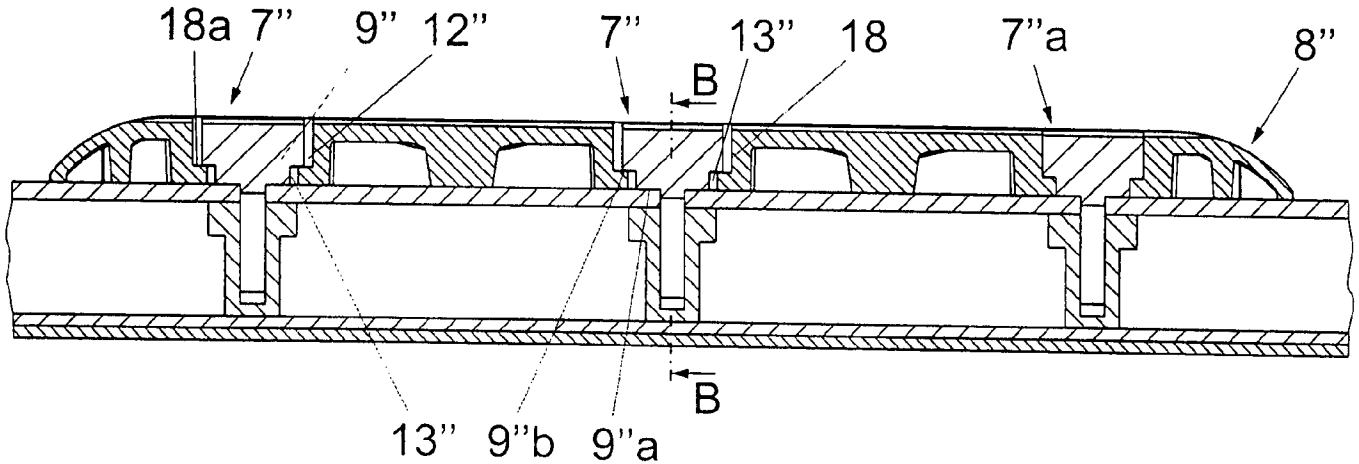

In the embodiment shown in FIGS. 6 and 7, the connection of the guide elements 8" to the ski 1" takes place via at least three fastening elements 7", 7"*a* which are held in a positionally fixed manner in the ski 1" and are in the form of snap bolts. The structure of the ski 1" is essentially the same as that according to previous illustrative embodiments and comprises a single-ply or multi-ply lower skin 4", a running surface 2", steel edges 3", a single-ply or multi-ply upper skin 5" and a foamed core 6". In this embodiment as well, a framework 14', which is provided with receiving parts 16' for receiving the fastening elements 7", 7"*a* in a positionally fixed, immovable manner, is accommodated in the interior of the ski. The receiving parts 16' therefore have a central receiving opening 15' and a supporting flange 16'*b* which surrounds an opening 5"*a* in the upper skin 5". The receiving opening 15' widens on the inside in the transverse direction of the ski via two shoulders 15'*a*, under which hook-like catching parts 10"*a* of the anchoring part 10" of each fastening element 7", 7"*a* can engage. A slotted design of this region of the anchoring parts 10" of the fastening elements 7", 7"*a* permits the necessary deformability.

Here, unlike in the embodiment according to FIGS. 4 and 5, the fastening elements 7", 7"*a* are located in the receiving opening 15' and in the opening 5"*a* in the upper skin 5" in an exactly fitting and positionally fixed manner, at least to a great extent. Consequently, no relative movement is permitted between the fastening elements 7", 7"*a* and the ski 1". Here, as in the embodiment according to FIGS. 1 to 3, movement of the guide elements 8" in the longitudinal direction of the ski is made possible between the fastening elements 7" and the guide element 8", which can be seen from the longitudinal section in FIG. 7. The receiving openings 18 provided in the guide element 8" for the fastening elements 7" allow relative movement of the guide element 8" in relation to the ski 1". To this end, a shoulder 9"*a* of the connecting part 9" can be supported around the opening 5"*a* in the upper skin 5" at least in the longitudinal direction of the ski, and another shoulder 9"*b* of the connecting part 9" can be supported on supporting flanges 18*a* of the receiving opening 18. Clearances 12", 13" provided in the longitudinal direction of the ski between the connecting part 9" and the guide element 8" in the region of the receiving opening 18 guarantee the desired mobility of the guide element 8". The fastening element 7"*a* fixes the guide element 8" immovably in relation to the ski 1" by virtue of fitting substantially exactly in the receiving opening 18 of the guide element 8". However, the positionally fixed fastening location can also be embodied in different ways.

According to these embodiments of the invention, it is therefore ensured that, when ski deflection occurs, relative movement which does not impede the ski deflection can take place between the ski, and the guide elements on the upper side of the ski. As mentioned, the variants illustrated and described are only illustrative embodiments, and a great many possibilities exist for fixing guide elements in relation to the ski in the manner according to the invention. For example, instead of a pair of guide elements, it is also possible to arrange a plate-shaped component or another component, which is provided as an interface between ski and binding. Moreover, the invention can also be applied to other sliding boards, in particular snowboards.

It should also be mentioned that at least two fastening elements are provided per guide element. It is also possible for more than one of the fastening elements to fix the guide element to the ski in an immovable or positionally fixed manner. It is also advantageous to carry out the positionally fixed arrangement of the guide elements in those end regions of the same which lie closer to the center of the ski.

Although the present invention has been described in relation to particular embodiments thereof, many other variations and modifications and other uses will become apparent to those skilled in the art. Therefore, the present invention is not limited by the specific disclosure herein.

What is claimed is:

1. A sliding board comprising:

a sliding board having an upper side and a lower side, a running surface and a foamed core;

at least one guide element for arranging at least one binding element on the upper side of the sliding board;

the guide element being connected to the sliding board via a plurality of fastening elements;

the guide element being immovably secured to the sliding board by at least one of the fastening elements in a positionally fixed manner;

the guide element being secured to the sliding board with limited mobility in the longitudinal direction of the sliding board by at least one other fastening element;

wherein the fastening elements comprise anchoring elements being immovably integrated into and held in the foam of the core exclusively by foaming of the core and hardening of the foam.

2. The sliding board as claimed in claim 1, wherein the other fastening element holds the guide element positionally fixed at least in the vertical direction and in the transverse direction of the sliding board.

3. The sliding board as claimed in claim 2, wherein the other fastening element is anchored firmly in the sliding board, the guide element being arranged for limited movement in the longitudinal direction in relation to said other fastening element.

4. The sliding board as claimed in claim 2, wherein the guide element has a receiving locations for the other fastening element, which receiving location has clearances in the longitudinal direction of the sliding board for limited mobility of the guide element in relation to the sliding board.

5. The sliding board as claimed in claim 1, wherein the guide element is arranged in a positionally fixed manner in one of its end regions in the longitudinal direction.

6. The sliding board as claimed in claim 5, wherein said end region is that end region which lies closer to the center of the sliding board.

7. The sliding board as claimed in claim 1, wherein the guide element is secured to at least one of the fastening elements in a positionally fixed manner with limited mobility to at least one other fastening element to permit deflection of the sliding board unimpeded by said guide element.

8. The sliding board as claimed in claim 1, wherein the fastening element arranging the guide element in a positionally fixed manner is firmly connected to the guide element.

9. The sliding board as claimed in claim 1, wherein the fastening element arranging the guide element in a positionally fixed manner is made in one piece with the guide element.

10. The sliding board as claimed in claim 1, wherein the fastening elements are arranged in openings formed in the upper side.

11. A sliding board comprising:

a sliding board having an upper side and a lower side, a running surface and a foamed core;

at least one guide element for arranging at least one binding element on the upper side of the sliding board;

the guide element being connected to the sliding board via a plurality of fastening elements;

the guide element being immovably secured to the sliding board by at least one of the fastening elements in a positionally fixed manner;

the guide element being secured to the sliding board with limited mobility in the longitudinal direction of the sliding board by at least one other fastening element;

wherein the fastening elements are anchored firmly to separate parts immovably integrated into and held in the foam of the core exclusively by foaming of the core and hardening of the foam.

12. The sliding board as claimed in claim 11, wherein the guide element is, together with the other fastening element, arranged for limited movement in the longitudinal direction in relation to the sliding board.

13. The sliding board as claimed in claim 12, wherein the other fastening element is in the interior of the sliding board, arranged for limited movement on a receiving part which is integrated by foaming of the core and hardening of the foam.

14. The sliding board as claimed in claim 13, wherein the receiving part provided in the interior of the sliding board for the fastening element is a component of a framework.

15. The sliding board as claimed in claim 13, wherein the receiving part has a receiving opening in which the other fastening element is held in a positionally fixed manner at least in the vertical direction and in the transverse direction.

16. The sliding board as claimed in claim 15, wherein the other fastening element is arranged for limited movement in the longitudinal direction of the sliding board in the receiving opening of the receiving part and also for limited movement in relation to the upper skin.

17. The sliding board as claimed in claim 15 or 16, wherein a clearance is provided in the longitudinal direction of the sliding board in an opening in the upper skin passed through by the other fastening element and in the receiving opening.

18. The sliding board as claimed in claim 13, wherein the other fastening element is held or anchored in the receiving part in the interior of the sliding board by snapping-in or locking.

19. The sliding board as claimed in claim 11, wherein the guide element is secured to at least one of the fastening elements in a positionally fixed manner and with limited mobility to at least one other fastening element to permit deflection of the sliding board unimpeded by said guide element.

* * * * *